US008939719B2

(12) United States Patent
Wan et al.

(10) Patent No.: US 8,939,719 B2
(45) Date of Patent: Jan. 27, 2015

(54) CENTRIFUGAL PUMP WITH OUTLET FLOW PASSAGE OF INCREASING CROSS-SECTION

(75) Inventors: Ying Juan Wan, Shenzhen (CN); Long Hing Tang, Hong Kong (CN)

(73) Assignee: Johnson Electric S.A., Murten (CH)

( * ) Notice: Subject to any disclaimer, the term of this patent is extended or adjusted under 35 U.S.C. 154(b) by 566 days.

(21) Appl. No.: 12/954,417

(22) Filed: Nov. 24, 2010

(65) Prior Publication Data

US 2011/0129337 A1 Jun. 2, 2011

(30) Foreign Application Priority Data

Nov. 27, 2009 (CN) ..... 2009 1 0189584

(51) Int. Cl.
*F04D 29/42* (2006.01)
*D06F 39/08* (2006.01)
*A47L 15/42* (2006.01)

(52) U.S. Cl.
CPC ..... *F04D 29/426* (2013.01); *D06F 39/085* (2013.01); *A47L 15/4225* (2013.01)
USPC ..... 415/206; 415/207

(58) Field of Classification Search
USPC ..... 415/204, 206, 71, 73, 207, 203
See application file for complete search history.

(56) References Cited

U.S. PATENT DOCUMENTS

| | | | | | |
|---|---|---|---|---|---|
| 1,065,732 | A * | 6/1913 | Schneible | 415/71 |
| 3,776,657 | A * | 12/1973 | Ask | 415/225 |
| 4,844,693 | A * | 7/1989 | Grzina | 415/197 |
| 4,900,225 | A * | 2/1990 | Wulf et al. | 415/224.5 |
| 5,044,882 | A * | 9/1991 | Akamatsu | 415/182.1 |
| 5,813,834 | A | 9/1998 | Hopfensperger et al. | |
| 6,146,095 | A | 11/2000 | Bross et al. | |
| 6,536,271 | B1 * | 3/2003 | Gopalakrishnan et al. | 73/168 |
| 6,779,974 | B2 | 8/2004 | Chien | |
| 2004/0115049 | A1 * | 6/2004 | Chien | 415/206 |
| 2005/0196274 | A1 * | 9/2005 | Kraffzik | 415/206 |

FOREIGN PATENT DOCUMENTS

| | | | |
|---|---|---|---|
| JP | 01142298 | A * | 6/1989 |
| SU | 1435847 | A * | 11/1988 |
| WO | WO 94/15102 | | 7/1994 |

* cited by examiner

*Primary Examiner* — Richard Edgar
*Assistant Examiner* — Kayla McCaffrey
(74) *Attorney, Agent, or Firm* — Muncy, Geissler, Olds & Lowe, P.C.

(57) ABSTRACT

A centrifugal pump includes a motor having an output shaft, a volute mounted at one side of the motor and an impeller which is located inside the volute and attached to the output shaft. The volute has an inlet arranged along the axial direction, an oulet arranged along the lateral direction and a flow channel arranged along the circumferential direction. The flow channel has a spiral shape. The cross-sectional area of the flow channel increases towards the outlet.

13 Claims, 4 Drawing Sheets

CENTRIFUGAL PUMP WITH OUTLET FLOW PASSAGE OF INCREASING CROSS-SECTION

CROSS REFERENCE TO RELATED APPLICATIONS

This non-provisional patent application claims priority under 35 U.S.C. §119(a) from Patent Application No. 200910189584.0 filed in The People's Republic of China on Nov. 27, 2009.

FIELD OF THE INVENTION

This invention relates to a centrifugal pump and in particular to a centrifugal pump for use in a domestic washing apparatuses such as washing machines for clothes and dishwashers.

BACKGROUND OF THE INVENTION

Domestic washing apparatuses such as washing machines and dishwashers are well known. A centrifugal pump is a key component of a washing apparatus and its performance can directly influence the performance of the washing apparatus.

Due to design drawbacks such as flow area of volute changing by an equal circle, existing centrifugal pumps have disadvantages such as excessive hydraulic loss.

The present invention aims to provide a new centrifugal pump with small hydraulic loss.

SUMMARY OF THE INVENTION

Accordingly, in one aspect thereof, the present invention provides a centrifugal pump comprising a motor having an output shaft, a volute mounted at one side of the motor and an impeller which is located inside the volute and attached to the output shaft, wherein the volute comprises an inlet arranged along the axial direction, an outlet arranged along the lateral direction and a flow channel arranged generally along the circumferential direction; the flow channel having a spiral shape and a cross-sectional area that increases in the direction of flow towards the outlet.

Preferably, the width of the flow channel increases in the direction of flow towards the outlet.

Preferably, the height of the flow channel increases in the direction of flow towards the outlet.

Preferably, the ratio between the inner radius of the flow channel and the outer radius of the impeller is between 0.8~1.2.

Preferably, two outlet spreading angles of the outlet of the volute are between 5~10 degrees.

Ideally, one of the outlet spreading angles is 8.8 degrees and the other is 6.5 degrees.

Preferably, the impeller comprises a base plate, a hub arranged at the center of the base plate and a plurality of blades arranged on the base plate.

Preferably, the hub has a conical shape and the ratio between the radius of the bottom of the hub and the outer radius of the base plate is between 0.3~0.5.

Preferably, the blade outlet angles of the blades are between 15~30 degrees.

Ideally, the blade outlet angles of the blades are 15 degrees.

Preferably, the flow channel is connected to the outlet by an outlet passage and the inner radius of the flow channel increases in the flow direction between the beginning of the flow channel and the outlet passage.

Alternatively, the inner radius of the flow channel is substantially constant in the flow direction between a region near the beginning of the flow channel and a region in the vicinity of the outlet passage and decreases in the region in the vicinity of the outlet passage.

An advantage of embodiments of the present invention is that hydraulic losses can be reduced as the cross-sectional area of the flow channel in the volute increases in the flow direction towards the outlet.

BRIEF DESCRIPTION OF THE DRAWINGS

Preferred embodiments of the invention will now be described, by way of example only, with reference to figures of the accompanying drawings. In the figures, identical structures, elements or parts that appear in more than one figure are generally labeled with a same reference numeral in all the figures in which they appear. Dimensions of components and features shown in the figures are generally chosen for convenience and clarity of presentation and are not necessarily shown to scale. The figures are listed below.

DETAILED DESCRIPTION OF THE PREFERRED EMBODIMENTS

Figure 1:
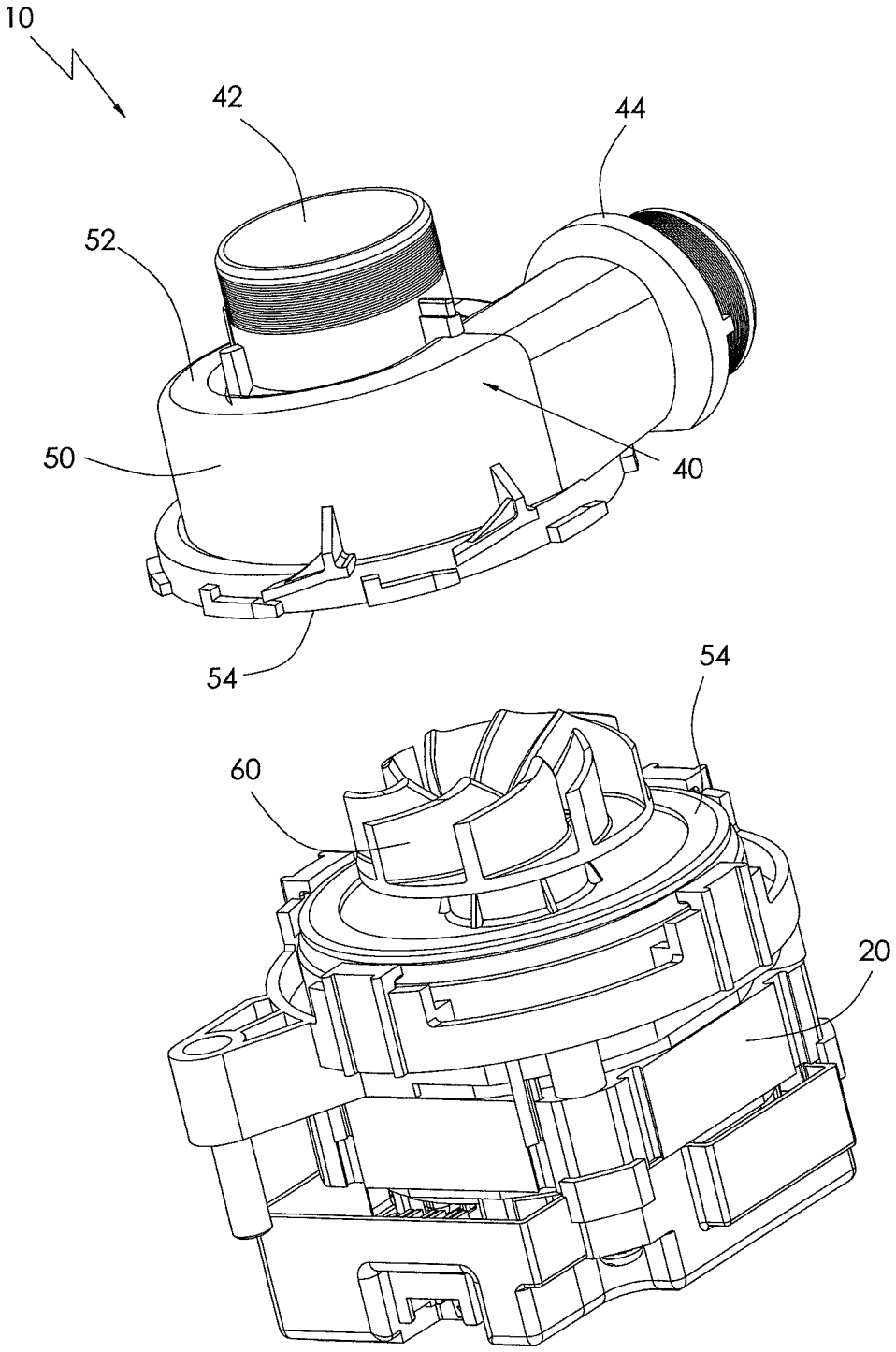
FIG. 1 is a partially exploded view of a centrifugal pump in accordance with the preferred embodiment of the present invention.
Figure 2:
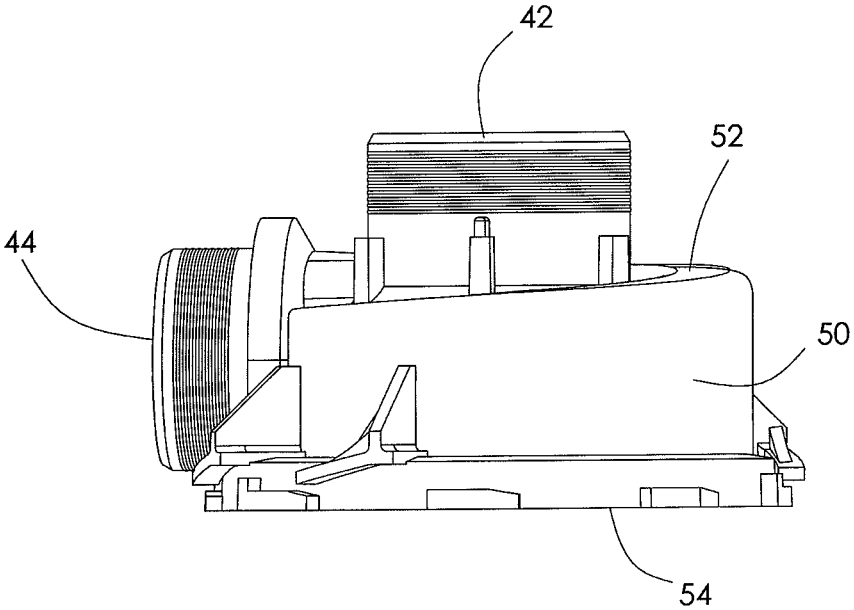
FIG. 2 is a side view of a volute of the centrifugal pump of FIG. 1.

A centrifugal pump 10, according to the preferred embodiment of the present invention, comprises a motor 20 having an output shaft, a volute 40 mounted at one side of the motor 20 and an impeller 60 which is located inside the volute 40 and attached to the output shaft of the motor 20.

The volute 40 comprises an inlet 42 arranged along the axial direction, an outlet 44 arranged along the lateral direction and a flow channel 46 generally arranged along the circumferential direction. The flow channel 46 has a spiral shape and its cross-sectional area increases in the direction of flow of the fluid (the flow direction) towards the outlet 44. This configuration helps to reduce hydraulic losses.

The flow channel 46 is formed between an inner wall 48, an outer wall 50, a top wall 52 and a bottom surface 54 formed on a mounting bracket fixed to the motor 20. In this embodiment, the bottom surface 54 is basically in a horizontal plane perpendicular to the output shaft and the top wall 52 extends along a spiral path so that the dimension of the flow channel 46 in the direction parallel with the output shaft, which is termed as the height of the flow channel 46, increases in the flow direction towards the outlet 44. The flow channel 46 forms an outlet passage 56 where it connects to the outlet 44.

Figure 3:
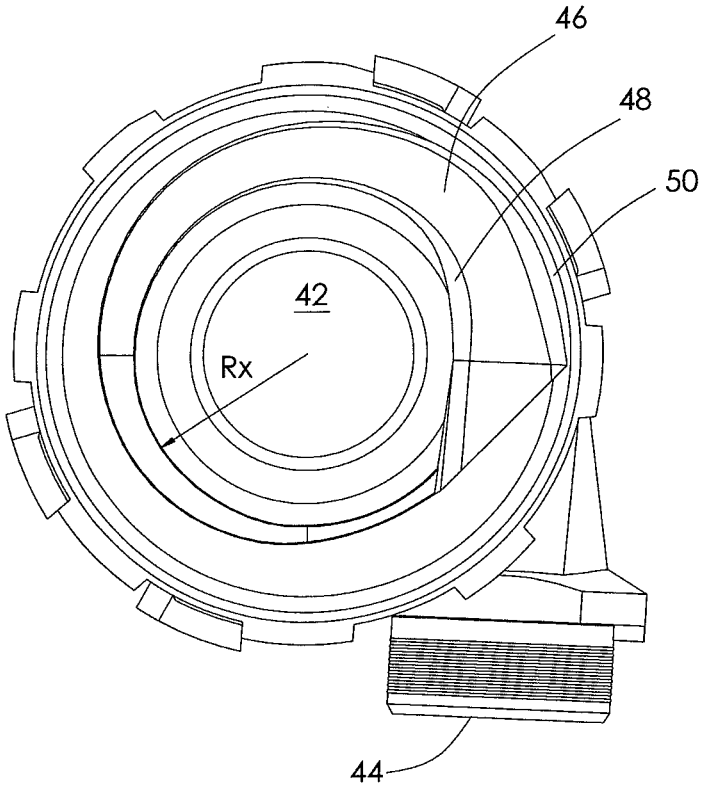
FIG. 3 is an inside view from below of the volute of FIG. 2.
Figure 3A:
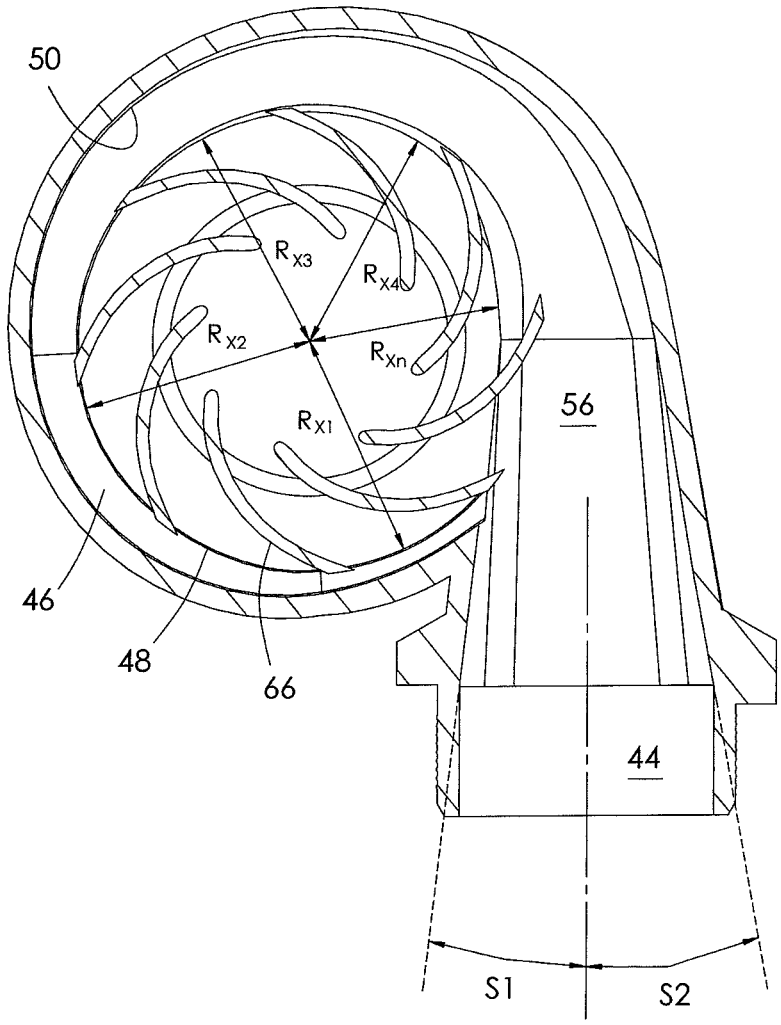
FIG. 3A is a sectional view of the pump, cut through the volute.

As shown in FIGS. 3 and 3A, the radius Rx, being the distance between the inlet center and the inner wall 48 of the flow channel (also referred to as the flow channel inner radius) is not constant. The radius Rx may be substantially constant from the beginning of the flow channel to a region where the flow channel becomes the outlet passage 56 where the radius Rx reduces such that the blades of the impeller extend further into the flow channel in the region of the outlet. Alternatively, the radius Rx may be constantly varying. For example, Rx may gradually increase decrease in the flow direction from the beginning of the flow channel to the outlet passage 56 where it rapidly decreases. This may occur continuously or in arcuate sections such that Rx1>Rx2>Rx3>Rxn. The actual decrease in Rx from Rx 1 to $Rx_{max}$ may be very small. Preferably, the ratio between Rx and the outer radius R2 of the impeller 60 is between 0.8~1.2. In this range the hydraulic losses should be less. As shown in FIG. 3A, the blades 66 of the impeller extend further into the flow channel in the region near to or forming the outlet passage joining the flow channel to the outlet 44. Preferably, the change in the radius Rx is gradual and smooth up to the point where the inner wall of the flow channel becomes the wall of the outlet passage, where the change may be more rapid. The dimension of the flow channel in the direction perpendicular to the output shaft, also known as the width of the flow channel 46, increases in the flow direction towards the outlet 44.

The outlet 44 of the volute forms a diverting passage and the angle that the side walls of the passage form with the axis of the outlet are referred to as outlet spreading angles. Thus the outlet has two outlet spreading angles: S1, adjacent the center of the volute; and S2, remote from the center of the volute, as shown in FIG. 3A. Preferably, the two outlet spreading angles of the volute 40 are between 5~10 degree and different from each other. Preferably, outlet spreading angle S1 is 6.5 degrees and outlet spreading angle S2 is 8.8 degrees.

Figure 4:
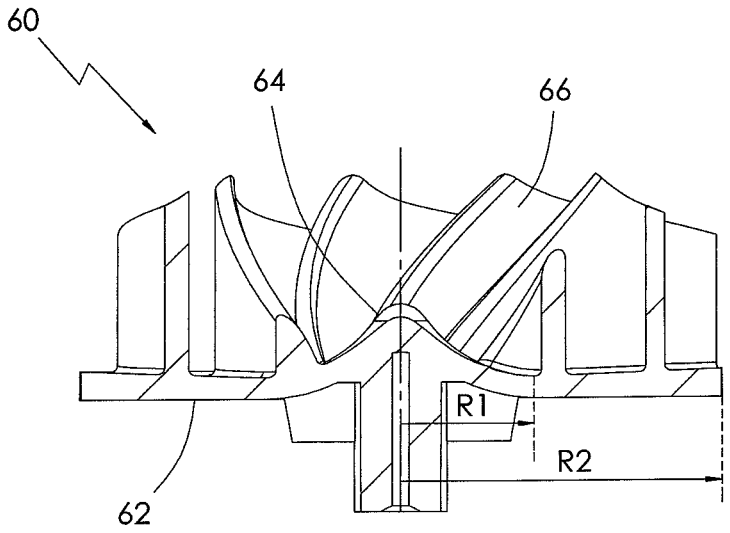
FIG. 4 is a sectional view of an impeller of the centrifugal pump of FIG. 1.
Figure 5:
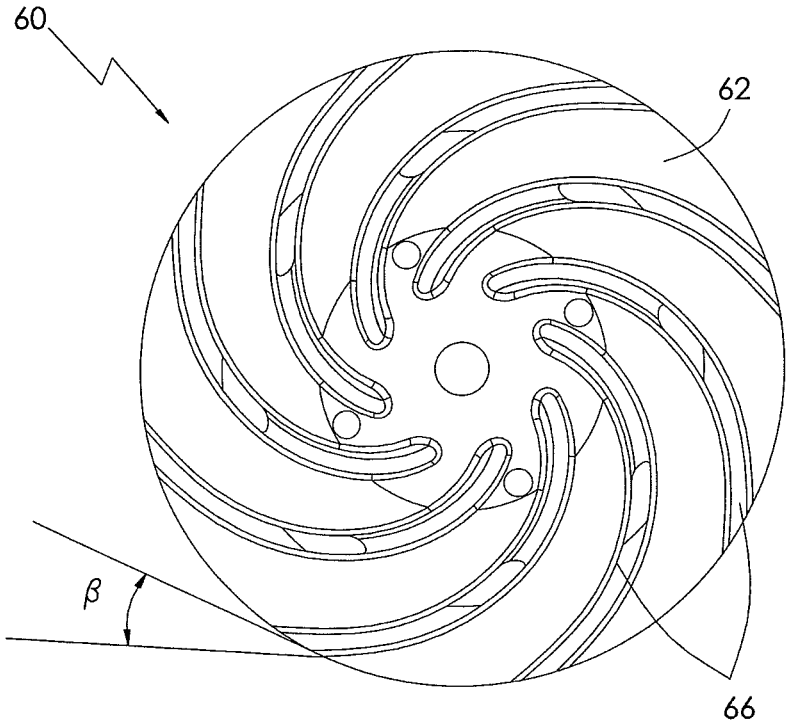
FIG. 5 is a view from above of the impeller of FIG. 4.

Referring to FIG. 4, the impeller 60 comprises a base plate 62, a conical hub 64 arranged at the center of the base plate 62 and a plurality of blades 66 arranged on the base plate 62. Preferably, the ratio between the radius R1 of the bottom of the hub 64 and the outer radius R2 of the base plate 62(also referred to as outer radius of the impeller 60) is between 0.3~0.5.

Preferably, blade outlet angles β of the blades 64 are between 15~30 degree. The blade outlet angle means an angle between a tangent to the end of the blade (on the working side) and a tangent to the outer circumference of the base plate 62 at the position of the end of the blade. In the preferred embodiment, the blade outlet angle β is 15 degrees.

In the description and claims of the present application, each of the verbs "comprise", "include", "contain" and "have", and variations thereof, are used in an inclusive sense, to specify the presence of the stated item but not to exclude the presence of additional items.

Although the invention is described with reference to one or more preferred embodiments, it should be appreciated by those skilled in the art that various modifications are possible. Therefore, the scope of the invention is to be determined by reference to the claims that follow.

The invention claimed is:

1. A centrifugal pump, comprising:

a motor having a shaft;

an impeller attached to the shaft of the motor; and a monolithic volute comprising:

a chamber enclosing the impeller;

an inlet along an axial direction of the shaft of the motor and communicating with the chamber;

a spiral flow channel communicating with the chamber and having a spiral inner wall with a decreasing radius of curvature between a first end and a second end along a flow direction;

an outlet passage having a first end coupled to the second end of the spiral flow channel and a second end; and an outlet connected to the second end of the outlet passage, wherein the outlet passage has an inner wail and an outer wall both being inclined with respect to a center line of the outlet, an outlet inner spreading angle formed between the inner wall of the outlet passage and the center line of the outlet being less than an outlet outer spreading angle formed between the outer wall of the outlet passage and the center line of the outlet.

2. The centrifugal pump of claim 1, wherein the flow channel has a cross section with a dimension along a radial direction of the chamber perpendicular to the shaft of the motor that increases in the flow direction.

3. The centrifugal pump of claim 2, wherein the cross section of the flow channel has another dimension parallel to the shaft of the motor that increases in the flow direction.

4. The centrifugal pump of claim 1, wherein a ratio between a distance formed between an inlet center and the inner wall of the flow channel and an outer radius of the impeller is between 0.8 ~1.2.

5. The centrifugal pump of claim 1, wherein:

the outlet passage has an inner wall and an outer wall; and the outlet inner spreading angle between the inner wall and the center line of the outlet is between 5 degrees and 10 degrees; and the outlet outer spreading angle between the outer wall and the center line of the outlet is between 5 degrees and 10 degrees.

6. The centrifugal pump of claim 5, wherein the outlet outer spreading angle is 8.8 degrees and the outlet inner spreading angle is 6.5 degrees.

7. The centrifugal pump of claim 1, wherein the impeller comprises a base plate, a hub arranged at the center of the base plate and a plurality of blades arranged on the base plate.

8. The centrifugal pump of claim 7, wherein the hub has a conical shape and the ratio between the radius of the bottom of the hub and the outer radius of the base plate is between 0.3 ~0.5.

9. The centrifugal pump of claim 7, wherein blade outlet angles of the blades are between 15 ~30 degrees.

10. The centrifugal pump of claim 9, wherein the blade outlet angles are 15 degrees.

11. The centrifugal pump of Claim 1, wherein the flow channel has a top wall which extends along a spiral path so that a height of the flow channel increases in the flow direction.

12. The centrifugal pump of claim 11, wherein a width of the flow channel increases in the direction of flow towards the outlet.

13. The centrifugal pump of claim 1, wherein the spiral flow channel surrounds the impeller less than 360 degrees.

* * * * *